US011603815B1

(12) United States Patent
Case, Jr.

(10) Patent No.: US 11,603,815 B1
(45) Date of Patent: Mar. 14, 2023

(54) MODULAR ARMATURE-NEEDLE ASSEMBLY FOR FUEL INJECTORS

(71) Applicant: Standard Motor Products, Inc., Long Island City, NY (US)

(72) Inventor: Kenneth Lee Case, Jr., Simpsonville, SC (US)

(73) Assignee: Standard Motor Products, Inc., Long Island City, NY (US)

( * ) Notice: Subject to any disclaimer, the term of this patent is extended or adjusted under 35 U.S.C. 154(b) by 0 days.

(21) Appl. No.: 17/518,800

(22) Filed: Nov. 4, 2021

(51) Int. Cl.
*F02M 51/06* (2006.01)

(52) U.S. Cl.
CPC ..... *F02M 51/0625* (2013.01)

(58) Field of Classification Search
CPC ..... F02M 51/0625
USPC ..... 239/585.3; 123/470, 490
See application file for complete search history.

(56) References Cited

U.S. PATENT DOCUMENTS 5,131,599 A 7/1992 Maier
6,363,915 B1 4/2002 Cohn
6,450,424 B1 9/2002 Horbelt
6,520,434 B1 2/2003 Reiter
6,808,133 B1 10/2004 Stier
6,938,839 B2 9/2005 Xu et al.
7,506,827 B2 3/2009 Petrone et al.
8,528,842 B2 9/2013 Hoang
8,556,194 B2 10/2013 Mieney et al.
8,646,704 B2 2/2014 Yamamoto et al.
9,175,655 B2 11/2015 Filippi et al.
9,359,984 B2 6/2016 Lyubar et al.
9,528,480 B2 12/2016 Omeri
9,903,327 B2 2/2018 Izzo et al.
2004/0026540 A1* 2/2004 Haeberer ..... F02M 47/027 239/585.1
2004/0026644 A1* 2/2004 Rapp ..... F02M 63/0015 239/533.8

* cited by examiner

*Primary Examiner* — Hai H Huynh
(74) *Attorney, Agent, or Firm* — Dykema Gossett PLLC

(57) ABSTRACT

Common component parts for an armature-needle assembly for aftermarket fuel injectors are described herein, where the common components include a needle, an armature, an upper stop flange, a lower stop flange, and one or more guide plates, the flanges and guide plates having apertures configured to accept the needle. The common components are capable of being assembled into at least three different armature-needle assemblies—de-coupled, floating, and fixed configurations. Further included are different sleeve configurations that allow for the adjustment to the induction and the ability to utilize a common solenoid in the different aftermarket fuel injector configurations.

12 Claims, 12 Drawing Sheets

MODULAR ARMATURE-NEEDLE ASSEMBLY FOR FUEL INJECTORS

BACKGROUND OF THE INVENTION a. Field of the Invention

The instant invention relates to an injector that supplies fuel to a combustible engine. In particular, the instant invention relates to a novel modular armature-needle assembly capable of being configured for replacement of multiple OEM fuel injectors.

b. Background Art

Original equipment manufacturers (OEMs) produce fuel injectors for vehicles that use an internal combustion engine. Known fuel injectors comprise an electromagnetic actuator that operates on a valve, typically in the form of a needle, to allow fuel to flow when energized. Common components of an electromagnetic actuator of known fuel injectors include a solenoid, a pole piece and an armature. When the solenoid is energized, a magnetic field is created with the pole plate that acts on the armature, causing it to move in an axial direction. The armature is mechanically coupled to the needle such that movement of the armature causes the needle to move in the axial direction. Energizing the solenoid typically results in opening the valve. A spring is also typically included to bias the needle into a closed position when the actuator is de-energized. Valve needles are typically comprised of hardened stainless steel for durability while armatures are typically made from a softer metal.

Different known configurations exist for mechanically coupling the armature and the needle to facilitate the movement of the needle when the actuator is energized. Three such configurations of needle-armature assemblies are: i) a de-coupled configuration, ii) a floating configuration, and iii) a fixed configuration.

In a known de-coupled configuration, the armature moves freely relative to the needle. The armature is constrained in the upward direction by either a flange at the top end of the needle or a separate armature stop that is welded to the top end of the needle. When energized, the armature engages the flange or armature stop to push the needle in the upward direction and thus opening the valve. A lower stop ring is welded to the needle to constrain the armature at a position when it is de-energized. An armature spring, held in place by a retainer attached to the armature, operates to keep the armature abutting against the lower stop ring when de-energized. In some instances, the armature spring also counters the force of the needle spring when the actuator is de-energized in order to lessen the impact of the armature against the lower stop ring. The needle spring operates against the flange or armature stop to keep the needle in its lower position, and thus closing the valve, when the armature is de-energized. One disadvantage of the de-coupled configuration is the presence of sliding friction between the hard metal needle and the soft metal armature. Plating and/or surface finishing on the inner diameter of the armature is often applied to prevent wear and lower sliding friction. The de-coupled configuration also requires several components, multiple welds, and precision translation gap setting, which increases manufacturing time and costs.

In a known floating configuration, the armature also moves freely relative to the needle. Additionally, as with the de-coupled configuration, the needle contains a flange machined into the top end of the needle that constrains the armature in the upward direction. The armature is constrained in the downward direction by a housing spring arranged between the armature and a stepped surface in the needle housing. The needle spring acts to force the needle into a closed position while the housing spring acts to force the needle into an open position. The force applied by the needle spring is greater than the force applied by the housing spring so that the needle remains in the closed position when the actuator is de-energized. When the actuator is energized, the armature is forced in the upward direction, engaging the needle flange in order to raise the needle into the open position. Like the de-coupled configuration, the floating configuration also has the issue of sliding friction between the soft metal armature and hardened needle, requiring a hard plating or smooth finish to be applied to the inner surface of the armature to prevent wear.

In a known fixed configuration, the armature is directly attached to the needle, such that the armature and needle move together in the axial direction. A common design involves a single piece armature that is crimped to the injector needle. In still other designs, there is a known two-piece armature having an intermediate plate that interconnects the armature directly to the needle. The armature floats freely within a cavity of the housing and the needle is kept in a closed position by a needle spring that acts upon the armature.

In addition to the three known configurations for coupling the armature and needle, as described above, fuel injectors come in different sizes for different vehicles, even those that may employ the same configuration. The length of needles may be different, or the axial position of the armature on the needle may be different.

As with most auto parts, there is a need for aftermarket fuel injectors. In order to reduce the costs of producing aftermarket fuel injectors for a wide variety of vehicles of different makes and models, it is desirable to manufacture interchangeable components that can be assembled into multiple different configurations. Specifically, is it advantageous and desirable to be able to produce common components of different armature-needle assemblies for fuel injectors that can be assembled into any of the de-coupled, floating, or fixed modular configurations described above.

It is also desirable to create replacement fuel injectors that overcome some of the known deficiencies seen in the different configurations. In particular, it is advantageous to avoid the excessive wear caused by mechanical sliding friction between the soft metal armature and hardened needle, and thus avoid the need for plating or smooth finishing on the armature inner diameter. Further, it is desirable to manufacturer a common needle on one size with flexibility to accommodate different desired armature positions relative to the needle.

Fuel injectors in general often suffer from gradual attrition of the mechanical parts due to recurrent and inconsistent movement of the parts. This can be the result of improper or unsound construction of the fuel injector or orientation of the moving parts therein. It is desirable, therefore, to create replacement fuel injectors having configurations and parts that lesson this problem.

OEM fuel injectors are known to have solenoids with varying coil resistances, inductive loads, and amp-turns. Solenoids are essentially comprised of a bobbin and a coil made of copper wire windings. Different OEM fuel injectors utilize different shapes and sizes of bobbins and variations on the coil windings to dictate the required magnetic field produced by the solenoid. To further achieve savings in the manufacture of different aftermarket replacement fuel injectors, it is desirable to utilize a single bobbin geometry for all replacement parts, varying only the wire diameter and number of windings for the coil to control the magnetic force of the solenoid. However, utilizing the same sized bobbin geometry in different configurations of aftermarket fuel injectors would produce different magnetic forces acting on the armature. There is thus a need to be able to easily and inexpensively adjust the electromagnetic forces acting on the armature in different armature-needle assemblies while using a common-sized bobbin geometry in the solenoid for each configuration.

Thus, there remains a need to address the problems described above in a simple, cost effective manner.

BRIEF SUMMARY OF THE INVENTION

In various embodiments, various common components capable of being assembled into different armature-needle assemblies for fuel injectors is disclosed. The common components may be assembled into multiple fuel injector configurations to replace fuel injectors in different makes and models of vehicles.

The common components for at least the three different armature-needle assembly configurations—de-coupled, floating, and fixed—may include a needle, an armature, one or more guide plate, an upper stop flange, a lower stop flange, and an armature spring. The needle may have a uniform diameter throughout its length, may be made of hardened stainless steel and may have a spherically ground tip at one end to engage a valve seat in a fuel injector body. All of the one or more guide plates and upper and lower stop flanges have apertures that are of uniform diameter and configured to accept the needle. The one or more guide plates are further capable of moving along the surface of the needle, with the internal surface of the aperture acting as a bearing surface for mechanical sliding. This solves the problem created when a soft metal armature is sliding directly against a hard metal needle.

In an embodiment of the invention, the common components may be assembled into a de-coupled armature-needle configuration. For example, a guide plate may be set within a recessed portion of the armature and fixed to the armature via, for example, a weld. The guild plate is located on the needle, and thus the armature is able to move along the needle surface with the guide plate acting as the bearing surface for mechanical sliding on the needle. The upper and lower stop flanges are fixed to the needle at positions above and below the guide plate, respectively, and confine the movement of the guide plate. The location of the lower stop flange along the needle can be adjusted to accommodate the required distance between the armature and the needle tip that engages the valve seat. In this embodiment, the armature spring is situated between an upper portion of the upper stop flange and the guide plate to create a downward force against the guide plate keeping it held against the lower stop flange when the valve is closed. The downward force also acts as a counter force to an energized armature to control an initial impact collision when the solenoid is first energized.

In another embodiment of the invention, the common components may be assembled into a floating armature-needle configuration. For example, a first guide plate may be set within a recessed portion of the armature and fixed to the armature via, for example, a weld. An upper stop flange is fixed to the needle above the first guide plate and is in contact with the first guide plate. In this embodiment, the needle, the first guide plate, the upper stop flange and the armature all move together. A second guide plate is located on the needle below the first guide plate, and is fixed relative to the needle within the valve housing. The needle is able to move relative to the second guide plate within an aperture in the guide plate. An armature spring is located between the first and second guide plates to provide a force below the armature. The armature spring can be sized to assist in valve opening time when the solenoid is energized, and to absorb some of the force the bias spring applies to the needle when the solenoid is de-energized.

In another embodiment of the invention, the common components may be assembled into a fixed armature-needle configuration. For example, a guide plate may be set within a recessed portion of the armature and fixed to the armature via, for example, a weld. The guide plate is further fixed to the needle, via, for example, a weld. An upper stop flange is fixed to the needle above the guide plate and is in contact with the guide plate. In this embodiment, the needle, armature, and guide plate move together along the axis of the fuel injector, with no relative movement between any of the three components. Energizing the solenoid thus will result in uniform movement of the armature, guide plate, and needle. The movement of the armature is constrained between a pole piece and the housing of the fuel injector valve, with the bias spring being the only force acting on the needle when the solenoid is de-energized.

Another aspect of this invention is the ability to utilize a common needle of uniform diameter in multiple different configurations of an armature-needle assembly. This further provides flexibility as it allows for various positioning of the armature along the needle to accommodate different configurations of OEM fuel injectors even when using the same armature-needle assemblies.

Another aspect of this invention is the ability to even utilize the same bobbin geometry for the solenoid in manufacturing aftermarket replacement fuel injectors. This further reduces the costs and complexity of manufacturing fuel injectors for multiple different makes and models of automobiles. The magnetic field produced by a solenoid with a common bobbin geometry can be adjusted by utilizing different coil diameters and the number of windings of the coil. However, there is still a need to be able to further adjust the magnetic forces of the solenoid within the different fuel injector designs. The invention provides for various sleeves to fit around the pole piece and armature in order to make adjustments to the induction to achieve the appropriate electromagnetic force. The invention includes sleeves made of different materials, both magnetic and non-magnetic, and having different configurations that affect the magnetic field generated by the solenoid. In this way, the invention can provide multiple different configurations with both the common armature-needle assembly parts and the same bobbin geometry for the solenoid.

The foregoing and other aspects, features, details, utilities, and advantages of the present invention will be apparent from reading the following description and claims, and from reviewing the accompanying drawings.

DETAILED DESCRIPTION OF THE INVENTION

Figure 1:
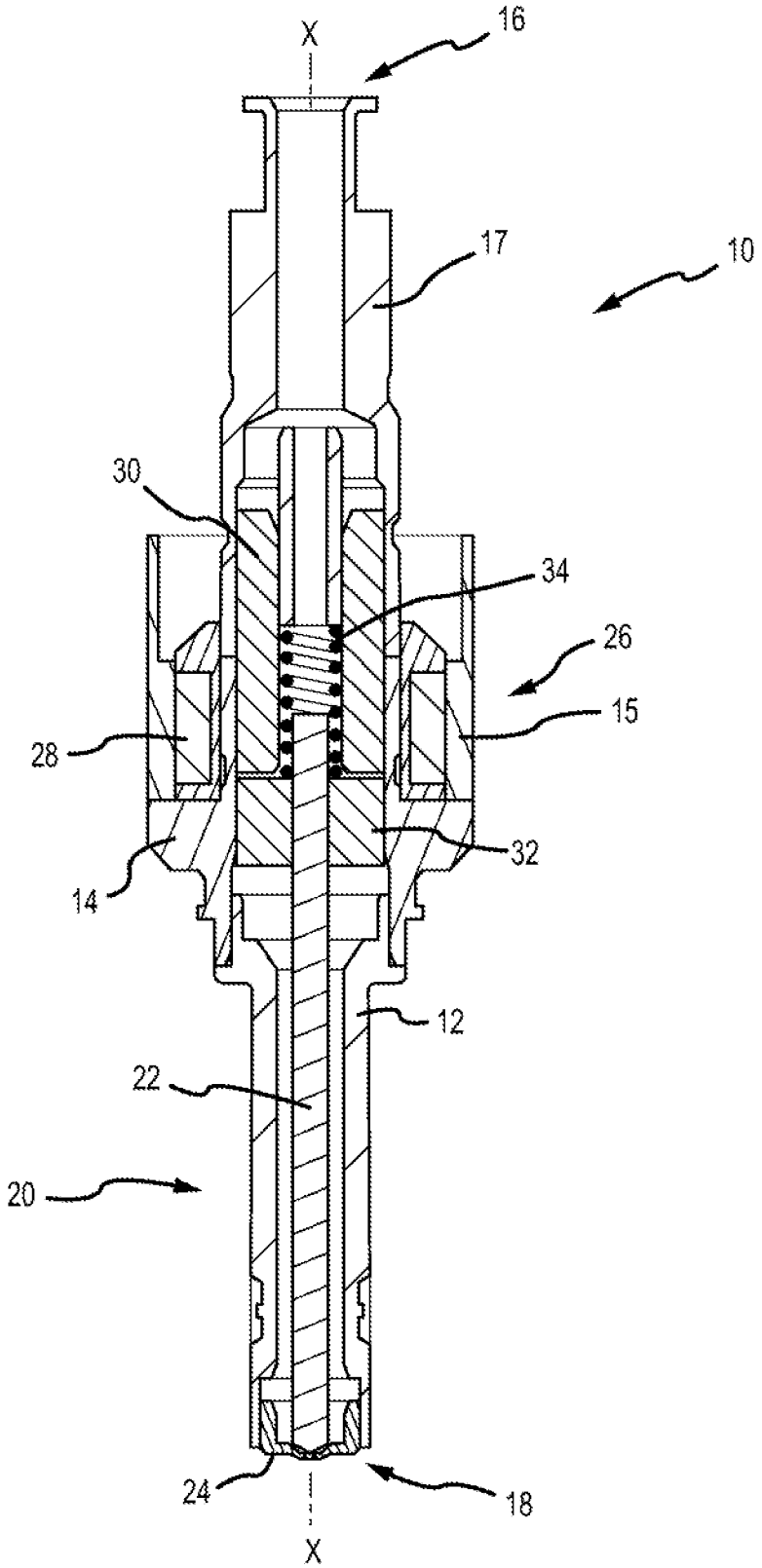
FIG. 1 is a cross-sectional view of a generic fuel injector capable of accepting a needle assembly comprised of the common components of the invention.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Referring now to the drawings wherein like reference numerals are used to identify the same or substantially similar components in the various views.

FIG. 1 shows a longitudinal section of a generic fuel injector 10 capable of being fitted with any of at least three different configurations for mechanically coupling an armature and needle. The fuel injector 10 comprises a longitudinal axis X, a lower valve housing 12, an upper valve housing 14, an armature housing 15, a top housing 17, a supply end 16, and an opposite nozzle end 18.

The fuel injector 10 further comprises a valve 20 and an electromagnetic actuator 26 for operating the valve 20. The valve 20 comprises a needle 22 and a valve seat 24 at the nozzle end 18 of the valve housing 12. The end of the needle 22 engages the valve seat 24 when the valve 20 is in a closed position, preventing the flow of fuel through fuel injector 10. The needle 22 is held in the closed position in the valve seat 24 via means of a bias spring 34 located at the top end of the needle 22.

The electromagnetic actuator 26 comprises a solenoid 28, a pole piece 30, and an armature 32. The solenoid 28 is configured to be electrically connected to a vehicle control unit (not shown) for the purpose of being energized. The pole piece 30 may be fixed to either the upper valve housing 14, the top housing 17 or both.

Typical operation of the fuel injector 10 will now be described. When the solenoid 28 is energized, it generates a magnetic field along a path through the pole piece 30 and the armature 32. A magnetic force is thus exerted on armature 32, attracting the armature 32 towards the pole piece 30, causing the armature 32 to move along the axis X towards the pole piece 30. When energizing stops, the force of the bias spring 34 moves the armature 32 into the opposite direction, in particular by means of mechanical interaction via the needle 22 and/or the armature 32 directly. The armature 32 is mechanically coupled, directly or indirectly, with the needle 22 so that the position of the needle 22 can be controlled electrically by the electromagnetic actuator 26 via the armature 32. It is preferred that the needle 22 is moved towards the open position when the solenoid 28 is energized and towards the closed position when no current flows through solenoid 28.

The mechanical coupling of the armature 32 and needle 22 can be accomplished through various armature-needle assemblies. For example, three such armature-needle assemblies are: 1) a de-coupled configuration; 2) a floating configuration; and 3) a fixed configuration. One aspect of the present invention is the creation of common components capable of being assembled into any of the three armature-needle assemblies, allowing for lower design and manufacturing costs for aftermarket replacement parts.

Figure 2A:
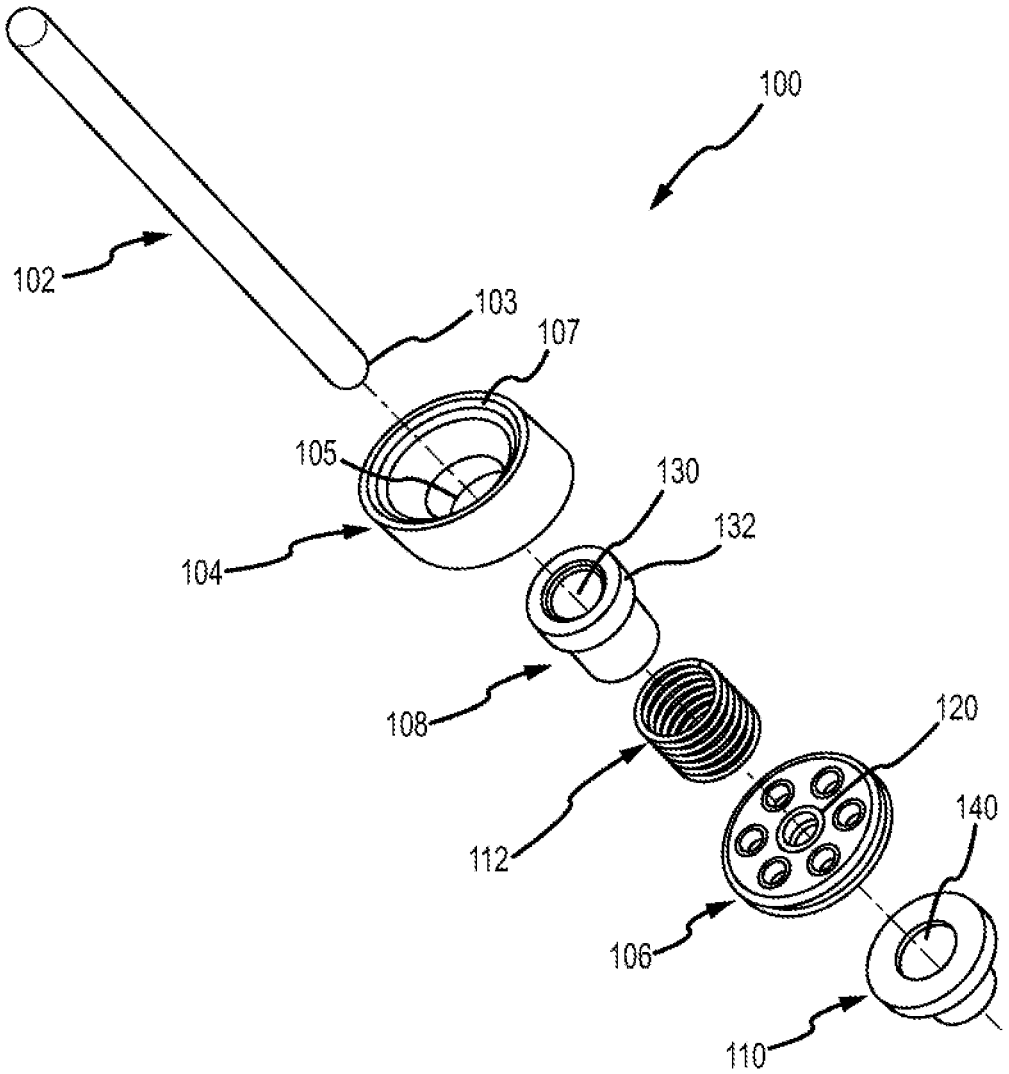
FIGS. 2A and 2B are exploded views of embodiments of the common components for multiple different armature-needle assemblies of the invention.
Figure 2B:
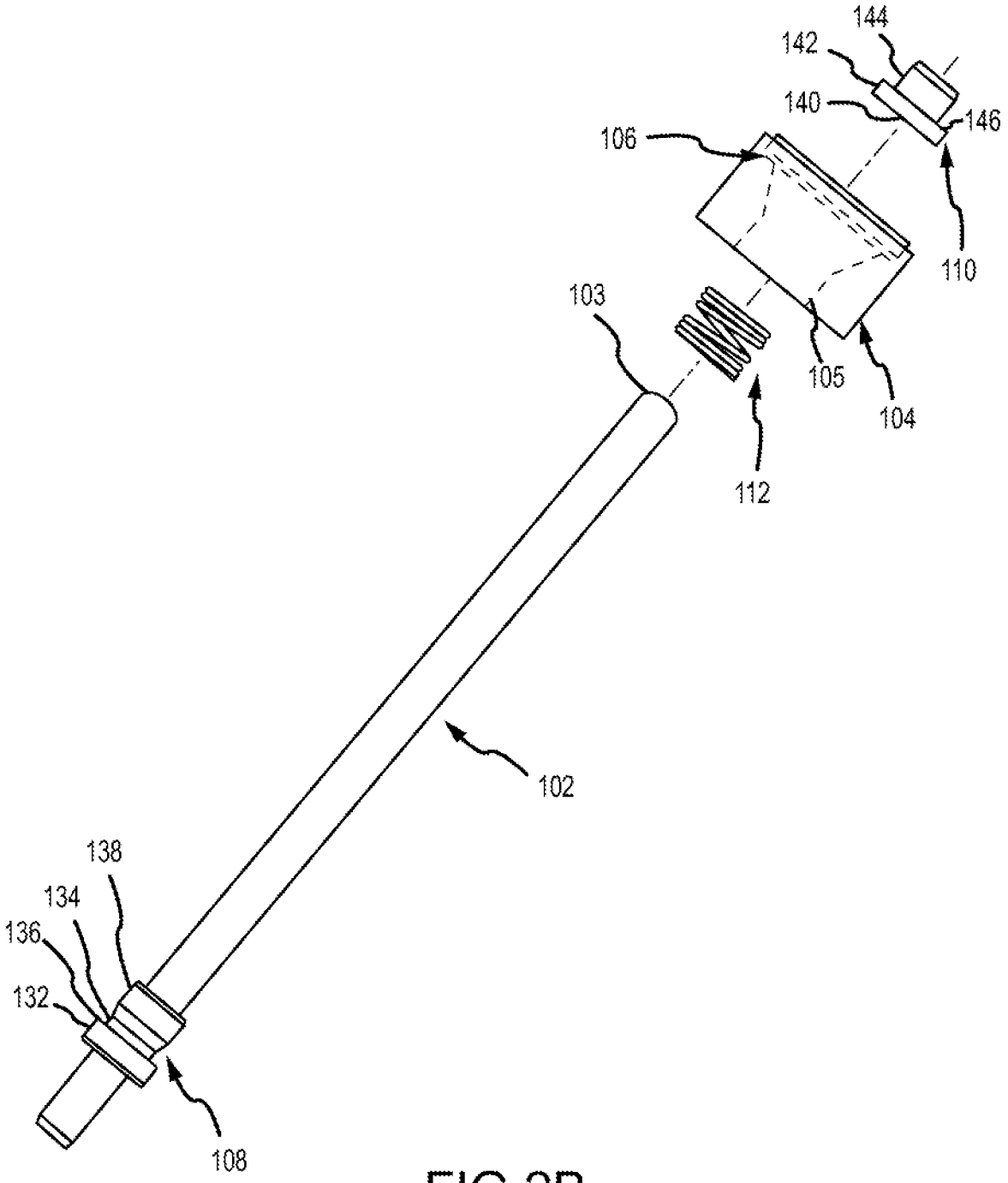

FIGS. 2A and 2B show the common components for at least three different armature-needle assemblies for different fuel injector configurations. The armature-needle assembly components include a needle 102, an armature 104, a guide plate 106, an upper stop flange 108, a lower stop flange 110 and an armature spring 112. In some embodiments, the needle 102 has a uniform diameter throughout its length, is made of hardened stainless steel and has a spherically ground tip 103 at one end, which engages the valve seat 24 when the fuel injector valve 20 is in a closed position. Further, in some embodiments, the armature 104 is in the shape of a cylindrical core, having an armature passage 105 located in the radial center of the armature 104 extending the length of the armature 104. The armature passage 105 has a diameter larger than the diameter of the needle 102.

The guide plate 106 has a circular disc shape with a center aperture 120 configured to accept the needle 102 and allow the guide plate 106 to move along the needle 102 in an axial direction. In two of the three configurations, as described below, the guide plate 106 acts as the bearing surface for mechanical sliding rather than having the armature 104 directly sliding against the needle 102, as seen in certain prior art fuel injectors. In some embodiments, the armature 104 is configured with a recessed portion 107 at one end to accept at least a portion of the guide plate 106.

Both the upper stop flange 108 and lower stop flange 110 have apertures 130, 140 respectively, that are of uniform diameter and configured to accept and fit snugly on the needle 102. In an embodiment, the upper stop flange 108 has regions of different outer diameters, including an upper region 132 having the maximum outer diameter of the upper stop flange 108. Immediately below the upper region 132 is a middle region 134 having the minimum outer diameter of the upper flange 108. At the transition between the upper region 132 and the middle region 134 is a ledge 136 that in some embodiments is configured to constrain the armature spring 112. The middle region 134 tapers to a lower region 138 having an outer diameter greater than the diameter of the middle region 134 but less than the diameter of the upper region 132.

In an embodiment, the lower stop flange 110 includes an upper portion 142 having the maximum outer diameter of the lower stop flange 110, and a lower portion 144 having a diameter less than the diameter of the upper portion 142. The transition between the upper portion 142 and the lower portion 144 creates a ledge 146 that, in an embodiment, is perpendicular to the axis of the aperture 140.

The components detailed above can be assembled into any of the three configurations of an armature-needle assembly for a fuel injector as previously described. Furthermore, the modularity of the components allows for positioning them at different locations along the length of the needle 102 to create multiple different products even within the different configurations. Three such embodiments of those armature-needle assemblies, utilizing the common components of the invention, will now be described in detail.

Figure 3:
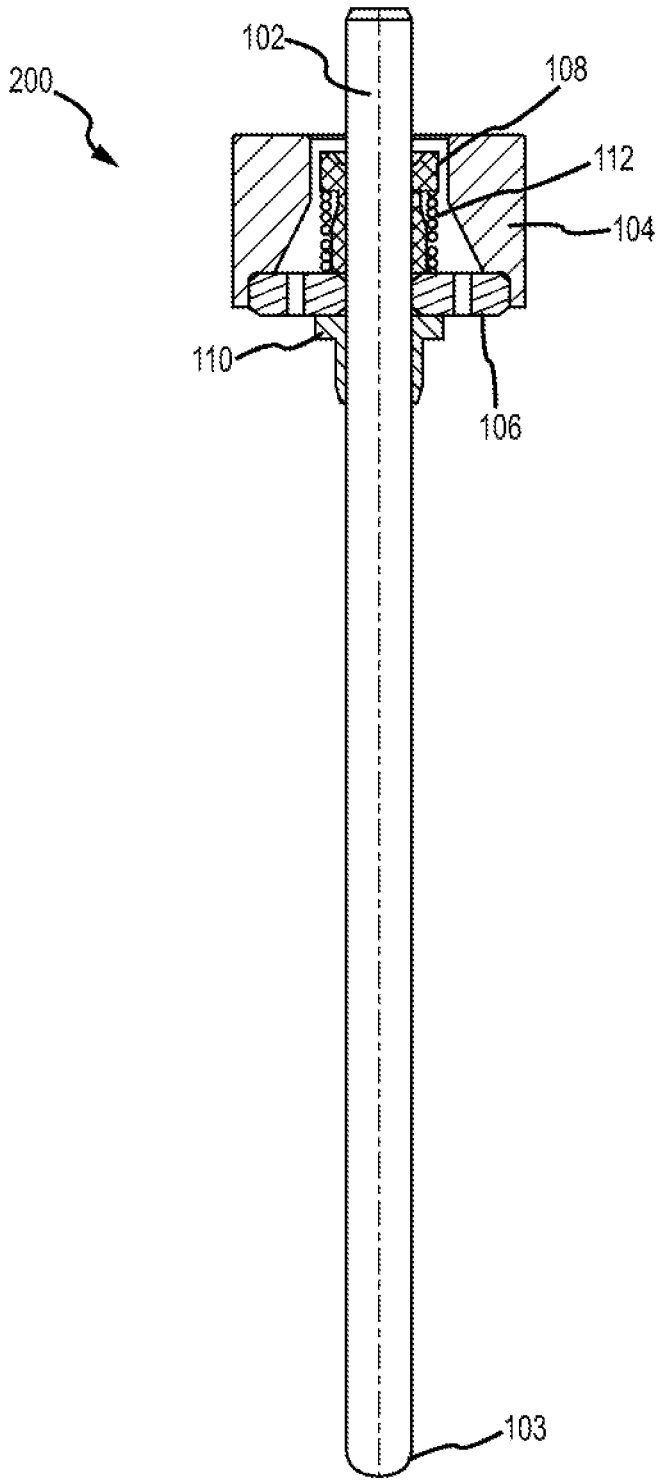
FIG. 3 is a cross-sectional view of a fuel injector armature-needle assembly for the de-coupled configuration according to one embodiment of the invention.
Figure 4:
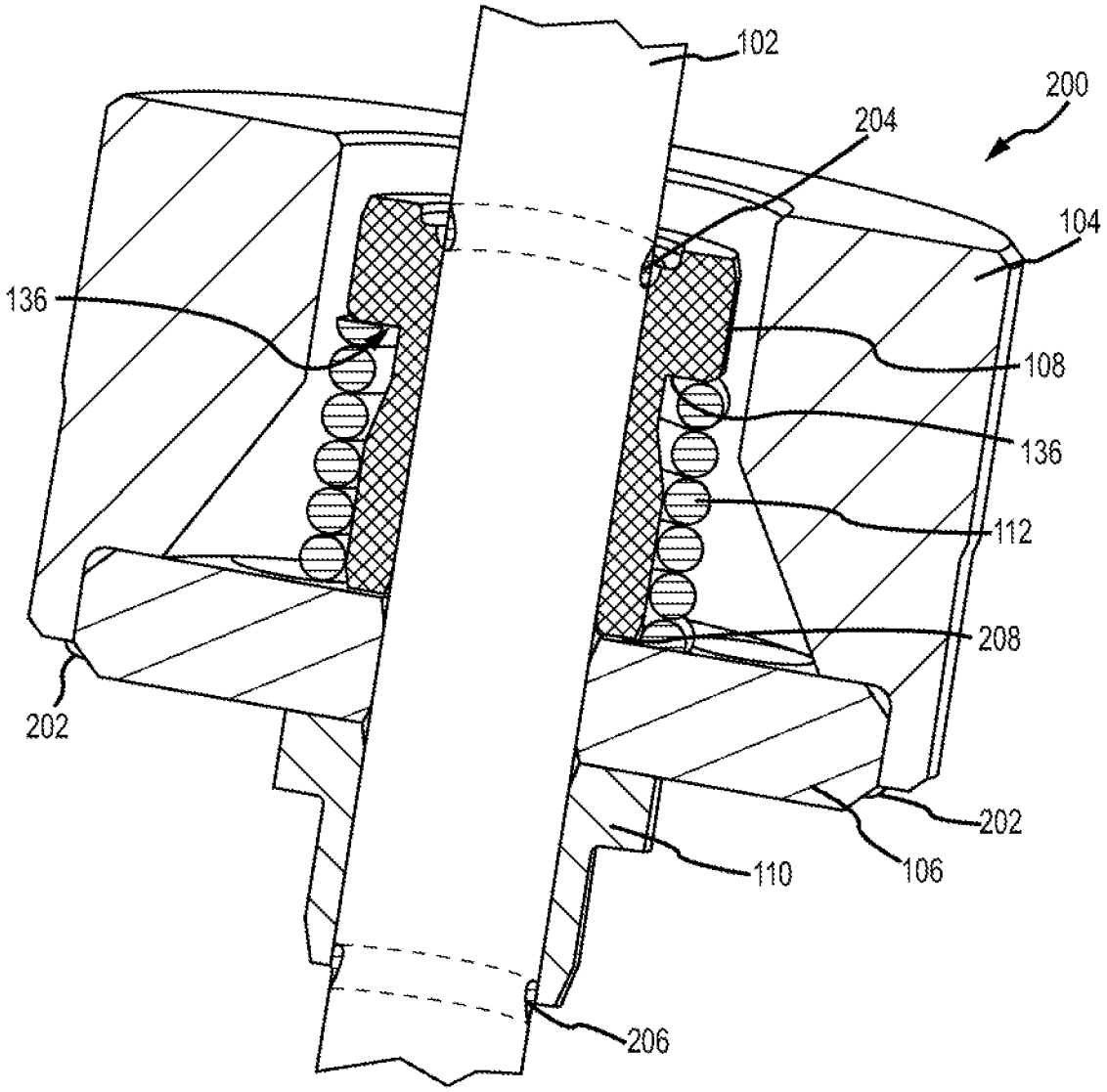
FIG. 4 is an enlargement of one portion of the embodiment of FIG. 3.
Figure 5:
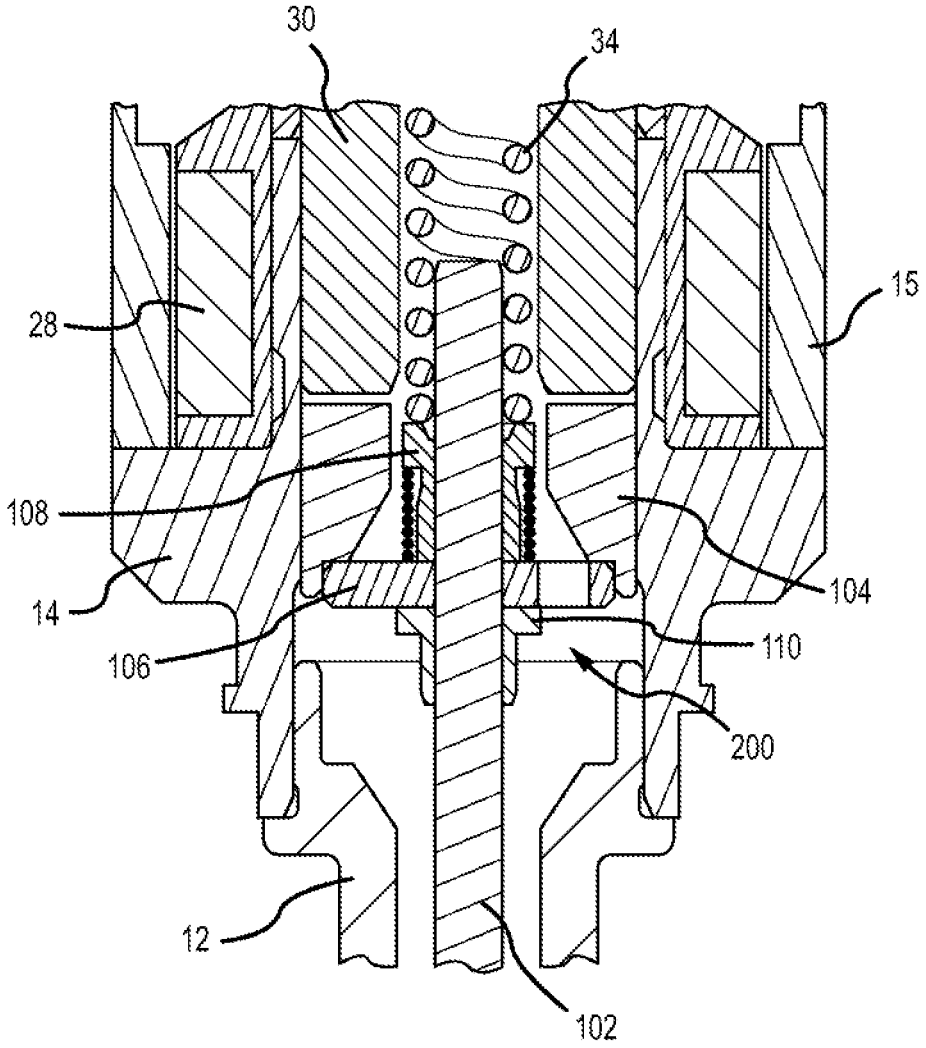
FIG. 5 is a portion of a cross-sectional view of the armature-needle assembly of FIG. 3 located in a fuel injector.

A de-coupled armature-needle assembly 200 for a fuel injector is shown in FIGS. 3, 4. FIG. 5 shows the de-coupled armature-needle assembly 200 located inside a fuel injector such as fuel injector 10. In this configuration, the armature 104 is attached to the guide plate 106. In one embodiment, the guide plate 106 is set within the recessed portion 107 of the armature 104 and is fixed to the guide plate 106 via weld 202. The weld 202 may extend around the entire circumference of the guide plate 106, or may be one or more spot welds around the circumference of the guide plate 106. The armature 104 is thus able to move relative to the needle 102 with the guide plate 106 acting as the bearing surface for mechanical sliding along the needle 102.

The upper stop flange 108 and lower stop flange 110 are both affixed to the needle 102 at positions that confine the movement of the guide plate 106, and thus the armature 104, to a pre-determined distance. In an embodiment, the upper stop flange 108 is fixed to the needle 102 via weld 204, and the lower stop flange 110 is fixed to the needle 102 via weld 206. Welds 204 and 206 may extend around the entire circumference of the needle 102, or may be one or more spot welds around the circumference of the needle 102. The location of the lower stop flange 110 along the needle 102 is set to create a pre-determined distance between the lower stop flange 110 and the spherically ground tip 103 of the needle 102.

In this embodiment, the armature spring 112 is positioned around the upper stop flange 108 and engages the ledge 136 of the upper stop flange 108, and a surface of the guide plate 106. In the resting or de-energized position when the valve is closed, the bias spring 34 is arranged around an upper portion of the needle 102, engaging a top surface of the upper stop flange 108. By applying a downward force on the top surface of the upper stop flange 108, the bias spring 34 maintains the needle 102 in a closed position when de-energized. The armature spring 112 creates a downforce against the guide plate 106, causing the guide plate 106 to rest against the lower stop flange 110. In an embodiment, when the bottom surface of the guide plate 106 is against the lower stop flange 110, there may be a gap 208 between the upper surface of the guide plate 106 and the upper stop flange 108. In some embodiments, the gap 208 may be approximately 50 μm.

When the fuel injector having the de-coupled armature-needle assembly 200 is energized, an electromagnetic force accelerates the armature 104 and attached guide plate 106 in an axially upward direction toward the upper stop flange 108, first creating an impact collision between the guide plate 106 and the upper stop flange 108, and then lifting the needle 102 into an open position by engaging with and lifting the upper stop flange 108. The initial impact collision aids in fast valve opening time. The armature spring 112 provides a counter force to the energized armature 104 and can be selected in order to control the force of the impact collision when the solenoid 28 is first energized.

Figure 6:
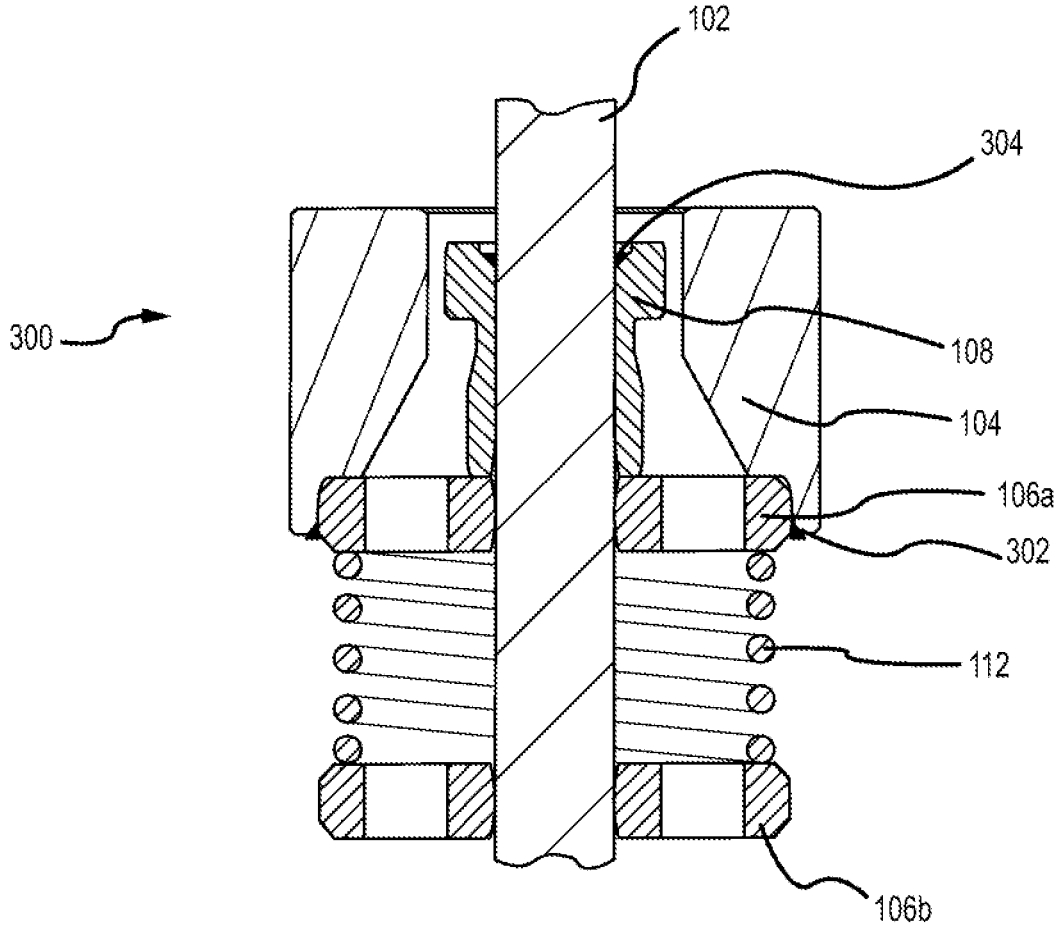
FIG. 6 is a cross-sectional view of a fuel injector armature-needle assembly for the floating configuration according to one embodiment of the invention.
Figure 7:
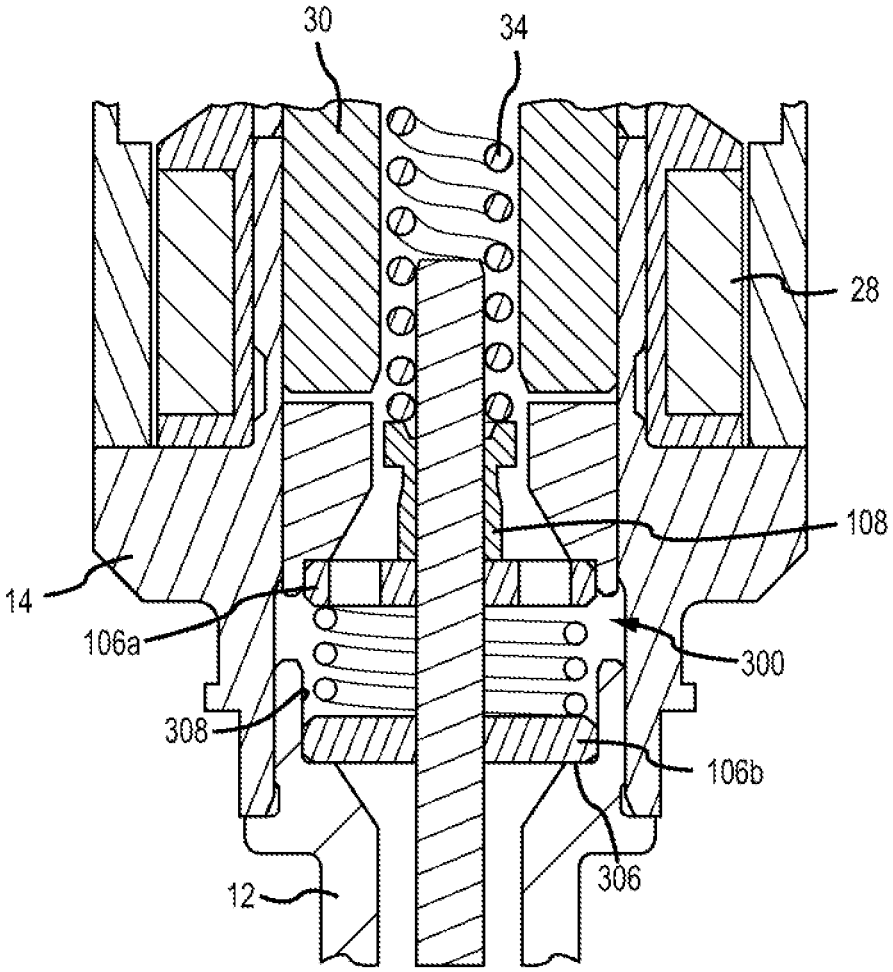
FIG. 7 is a portion of a cross-sectional view of the armature-needle assembly of FIG. 6 located in a fuel injector.

An assembled floating armature-needle assembly 300 for a fuel injector is shown in FIG. 6. FIG. 7 shows the floating armature-needle assembly 300 situated within a fuel injector such as fuel injector 10. In an embodiment, similar to the de-coupled armature-needle assembly 200, the upper stop flange 108 is fixed to the needle 102 via weld 304, that may be continuous around the outer circumference of the needle 102 or may consist of one or more spot welds around the circumference. Also similar to the de-coupled armature-needle assembly 200, a first guide plate **106*a* is fixed to the armature 104 via weld 302, which also may be continuous around the needle 102 or consist of one or more spot welds. A second guide plate 106*b* is situated below the first guide plate 106*a* and situated on a ledge 306 within the valve housing 12. In an embodiment, the second guide plate 106*b* is press fit into a space created by an internal surface 308 of the valve housing 12 and the ledge 306. The armature spring 112 is located between the first guide plate 106*a* and the second guide plate 106*b* to provide a force below the armature 104. The armature spring 112 can be selected and pre-loaded to assist in valve opening time when the solenoid 28 is energized. When the solenoid 28 is de-energized, the bias spring 34 forces the needle 102 downward, causing the armature 104 and first guide plate 106*a* to move in the same direction. The armature spring 112 absorbs some of the loading on the needle 102 by acting against the acceleration of the needle 102 in order to reduce the bounce of the needle 102 against the valve seat 24**.

Figure 8:
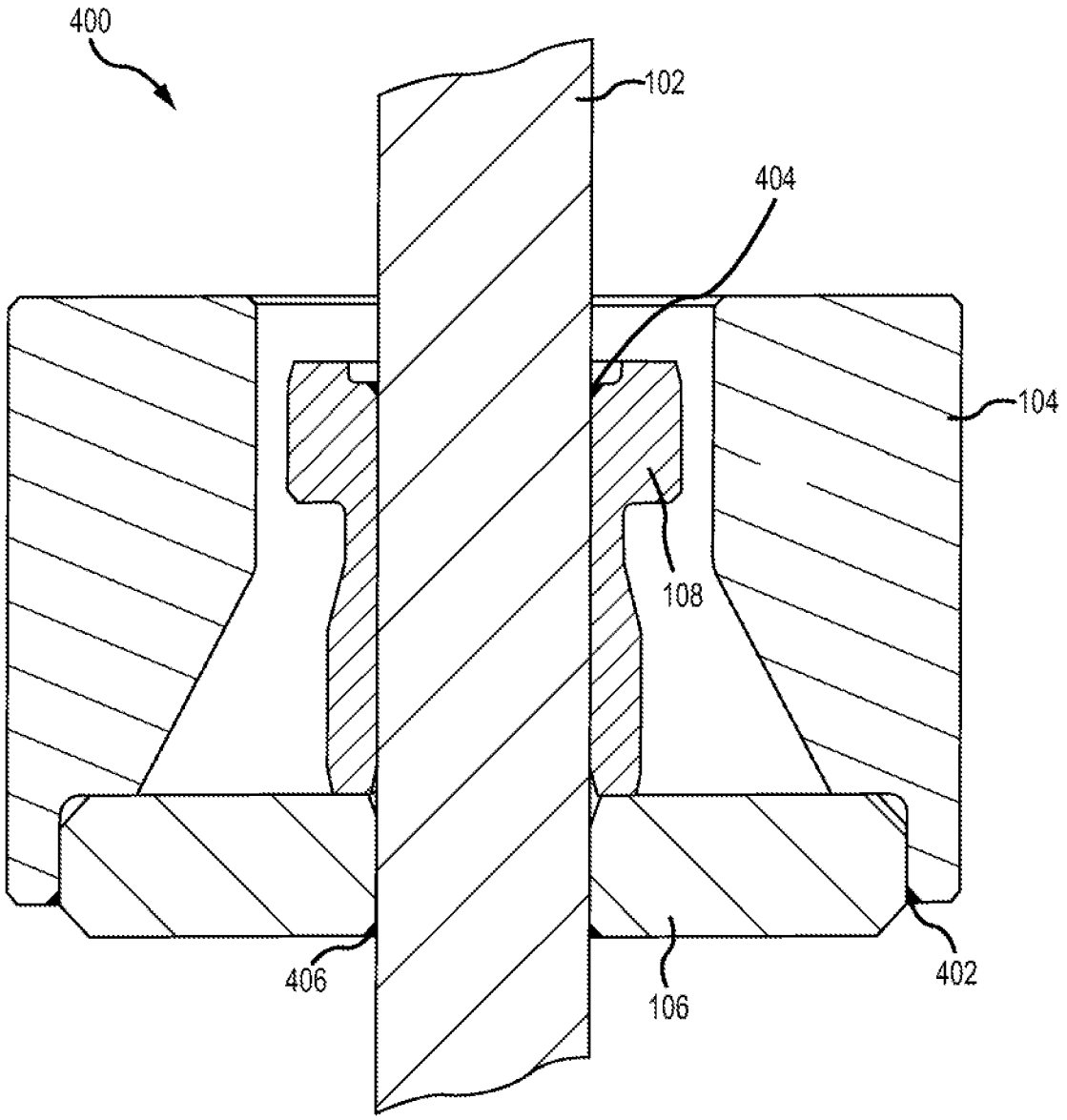
FIG. 8 is a cross-sectional view of a fuel injector armature-needle assembly for the fixed configuration according to one embodiment of the invention.
Figure 9:
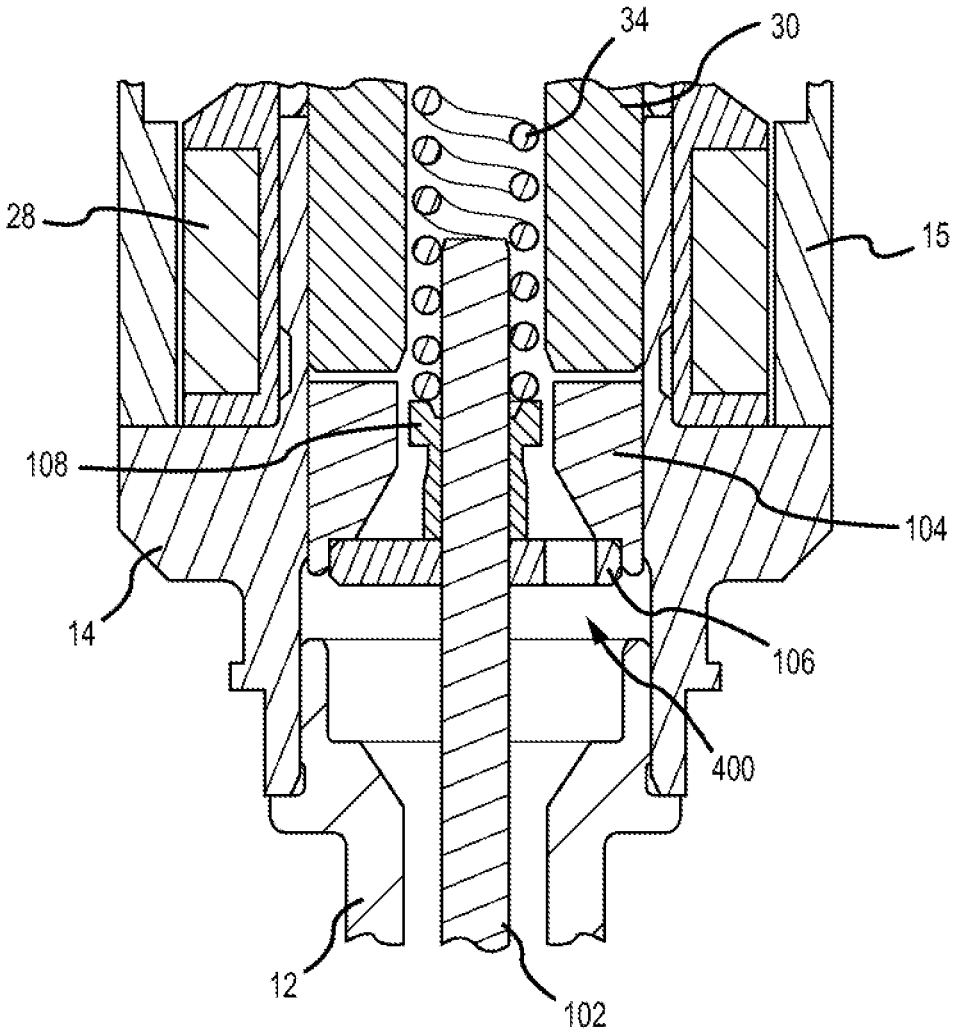
FIG. 9 is a portion of a cross-sectional view of the armature-needle assembly of FIG. 8 located in a fuel injector.

An assembled fixed armature-needle assembly 400 for a fuel injector is shown in FIG. 8. FIG. 9 shows the fixed armature-needle assembly 400 situated within a fuel injector such as fuel injector 10. In an embodiment, similar to the de-coupled armature-needle assembly 200 and floating armature-needle assembly 300, the guide plate 106 is fixed to the armature 104 via weld 402, which may be continuous around the outer circumference of the guide plate 106 or may consist of one or more spot welds around the circumference of guide plate 106. Also, upper stop flange 108 is fixed to the needle 102 via weld 404. For the fixed armature-needle assembly 400, the guide plate 106 is also fixed to the needle 102. In an embodiment, the guide plate 106 is fixed to the needle 102 via weld 406, which may be continuous around the circumference of the needle 102 or via one or more spot welds around the circumference of the needle 102.

Welds 404 and 406 are positioned along the needle 102 such that the upper stop flange 108 is in contact with guide plate 106. Due to the welds 404 and 406, the needle 102, armature 104 and guide plate 106 move together along the axis X, with no relative movement between any of the three components. Thus, energizing the solenoid 28 will result in uniform movement of the armature 104, guide plate 106 and needle 102.

In a fuel injector 10 having the fixed armature-needle assembly 400, the movement of the armature 104 is constrained between the pole piece 30 and the configuration of the valve housing 12. The bias spring 34 is the only force acting on the needle 102 to keep it in the closed position when the solenoid 28 is de-energized. When the solenoid 28 is energized, the electromagnet force drawing the armature 104 toward the pole piece 30 is the only force acting on the needle 102 to lift the needle 102 off the valve seat 24, opening the valve 18.

The above description shows how several common components can be arranged into at least three different configurations to meet the functional requirements of a variety of OEM fuel injectors. The advantage is that a replacement parts manufacture can produce a limited number of parts that can be assembled into multiple different replacement fuel injectors. Additionally, utilizing a needle 102 of a uniform diameter, as in some embodiments, allows for positioning of the armature 104 at different positions along the needle 102, thus allowing for the production of even more variations of a fuel injector, even within the same armature-needle assembly configuration. The simplicity of the design of a uniform diameter needle also allows for very precise form tolerances and concentric alignment in the assembly, which reduces the need for other expensive components and assembly equipment.

In those embodiments where the armature 104 moves relative to the needle 102, such as the de-coupled and floating armature-needle assemblies 200, 300, the use of the guide plate 106 as a bearing surface for sliding contact is an advantage over the prior art at least because there is no need for plating or super finishing on the internal surface of the armature to protect the soft metal armature from the hardened needle. This produces greater reliability and longer life of the needle, the armature, and other fuel injector mechanical parts. The use of the guide plate 106 rather than the armature 104 as the sliding surface also gives rise to a shorter bearing length, or depth of the thru hole, allowing for the armature and guide plate to tilt more freely relative to the needle. This design improves the precision of the concentricity and form for the armature-needle assembly, and allows for less sensitivity to being out of specification, further minimizing wear issues and improving operational consistency of the mechanical parts in the armature-needle assembly.

Figure 10:
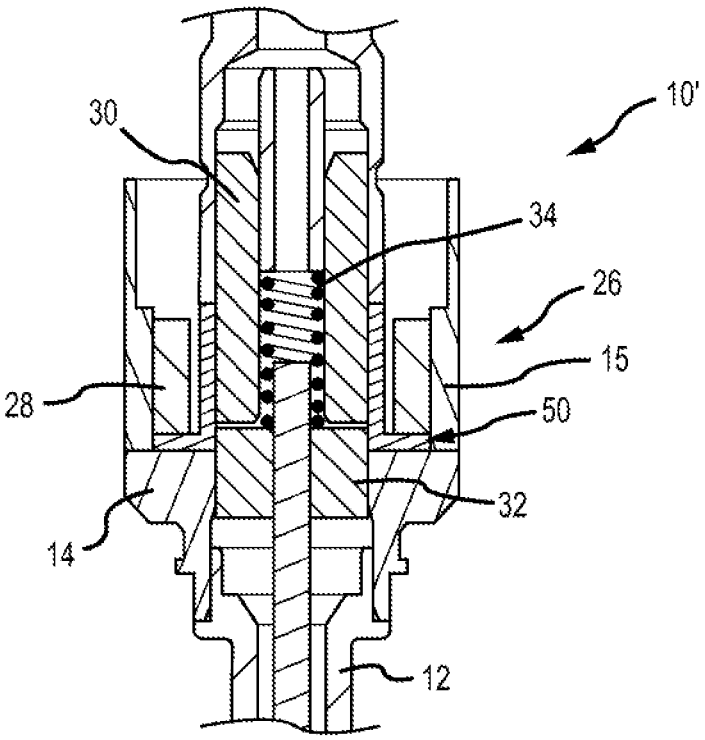
FIG. 10 is a portion of a cross-sectional view of another embodiment of the generic fuel injector of FIG. 1.

In addition to using the same common parts described above to create a variety of different replacement fuel injectors, it is also desirable to utilize the same bobbin geometry for the solenoid 28, and only varying the wire diameter and number of windings for the coil with the solenoid 28. However, given the multiple different OEM fuel injector shapes and coil resistances, inductive loads, and amp-turn requirements, utilizing a common sized bobbin geometry for the solenoid 28, even with different coil wire and winding diameters, would produce different electromagnetic forces acting on the armature 104. Adjustments in the induction can be provided by modifying a sleeve 50 that fits around the pole piece 30 and armature 104, and which the solenoid 28 resides exterior to. An embodiment of the fuel injector shown in FIG. 1, fuel injector 10', having such a sleave 50 is shown in FIG. 10. The sleeve 50 has a uniform internal diameter on the surface facing the pole piece 30 and armature 28. Different configurations and material of the sleeve 50 can change the induction sufficient enough to allow use of a common bobbin geometry in the solenoid in a variety of different replacement OEM fuel injectors.

Figure 11A:
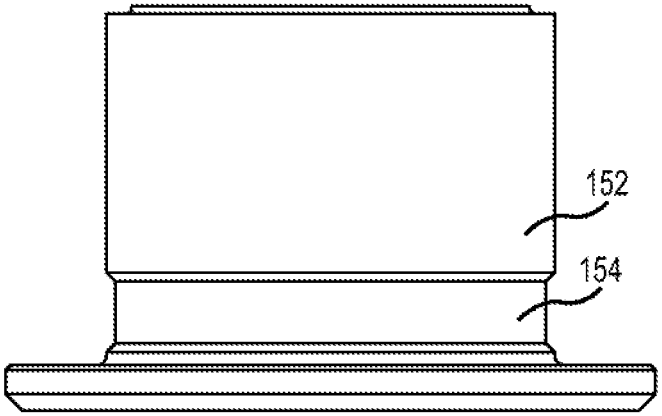
FIGS. 11A-11C are front views of different embodiments of a sleeve for the invention.
Figure 11B:
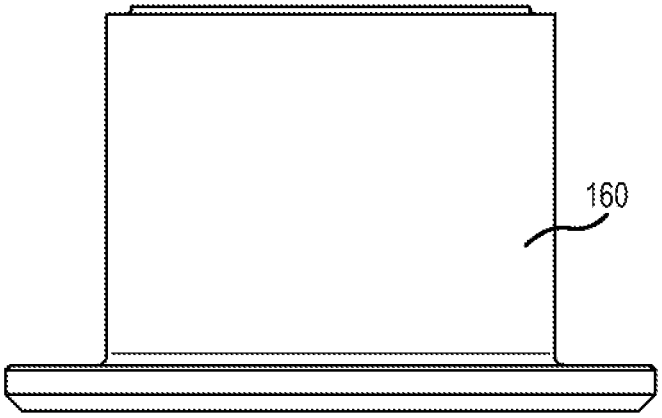
Figure 11C:
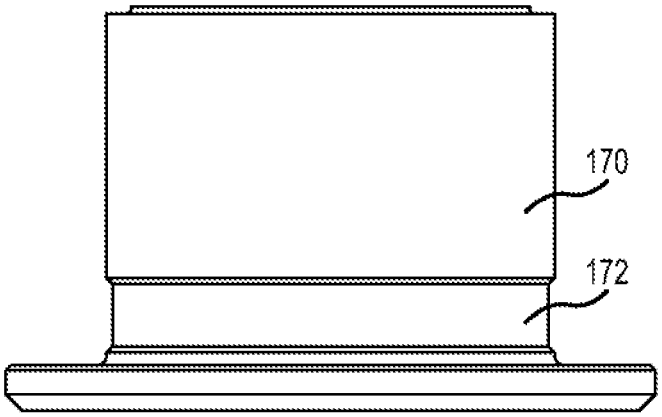

Different sleeve variations are shown in FIGS. 11A, 11B & 11C. In one embodiment, a sleeve 152 made from a ferritic material and contains a throttle section 154, which is a section having decreased thickness from the rest of the vertical section of the sleeve. Sleeve 152 provides a high induction as magnetic field generated by the solenoid 28 becomes saturated at the throttle section 154, causing a greater magnetic force to act upon the armature 28. In another embodiment, sleeve 160 is used in the fuel injector. Sleeve 160 is made from a non-magnetic material and has a uniform thickness throughout the vertical section of the sleeve 160. Sleeve 160 provides a low induction as none of the magnetic field produced by the solenoid 28 passes through the sleeve 160. In another embodiment, sleeve 170 is made from a martensitic stainless steel and also contains a throttle section 172. Sleeve 170 provides a medium induction between the amount provided by sleeves 152 and 160.

Each of the sleeves 152, 160 and 170 may be used with any of the armature-needle assemblies 200, 300 or 400, and may provide for changing the induction in different embodiments of an armature-needle assembly while also utilizing the same common bobbin geometry in solenoid 28. This adds another layer of cost savings and simplification manufacturing aftermarket fuel injectors.

Although various embodiments of this invention have been described above with a certain degree of particularity, those skilled in the art could make numerous alterations to the disclosed embodiments without departing from the spirit or scope of this invention. All directional references (e.g., upward, downward, top, bottom, inner, outer, vertical and horizontal) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements It is intended that all matter contained in the above description or shown in the accompanying drawings shall be interpreted as illustrative only and not limiting. Changes in detail or structure may be made without departing from the spirit of the invention as defined in the appended claims

What is claimed is:

1. An armature-needle assembly for aftermarket fuel injectors, the armature-needle assembly being capable of being assembled into different configurations, the armature-needle assembly comprising:

a needle having a nozzle end;

an armature;

at least one stop flange having an aperture for receiving the needle and located on the needle;

at least one guide plate having an aperture for receiving the needle and located on the needle, the aperture configured to allow the guide plate to slide along the needle; and at least one coiled spring configured to surround the needle, and located concentric with the axis of the needle, wherein one of the at least one guide plate is fixed to the armature and arranged within a recess located on one end of the armature.

2. The armature-needle assembly of claim 1, wherein the stop flange is a first stop flange and is located on the needle above the guide plate, is fixed to the needle, and further comprises a ledge, the armature-needle assembly further comprising:

a second stop flange located on the needle and below the guide plate, the second stop flange being fixed to the needle, wherein the coiled spring is located on the needle and constrained between the ledge of the first stop flange and the guide plate.

3. The armature-needle assembly of claim 2, wherein a gap exists between the first stop flange and the guide plate when no magnetic force is applied to the armature.

4. The armature-needle assembly of claim 2, wherein a magnetic force applied to the armature results in movement of the armature, guide plate, first stop flange and needle in a direction along the axis of the needle.

5. The armature-needle assembly of claim 1, wherein the guide plate is a first guide plate, and the stop flange is located on and fixed to the needle above the first guide plate, the armature-needle assembly further comprising:

a second guide plate located on the needle below the first guide plate and configured to allow the needle to move relative to the second guide plate, wherein the coil spring is located on the needle, between and constrained by the first guide plate and the second guide plate.

6. The armature-needle assembly of claim 5, wherein the stop flange is arranged on the needle so as to be in direct contact with the first guide plate.

7. The armature-needle assembly of claim 1, wherein:

the guide plate is fixed to the needle, the stop flange is located on the needle above the guide plate, is fixed to the needle, and is in direct contact with the guide plate, and the coiled spring is located at least partially on the needle located above the stop flange, and being in contact with the stop flange, the coiled spring being the only force acting upon the stop flange when no magnetic force is applied upon the armature.

8. The armature-needle assembly of claim 7, wherein a magnetic force applied to the armature results in movement of the armature, guide plate, stop flange and needle, together, against the coiled spring.

9. The armature-needle assembly of claim 1, further comprising a sleeve surrounding the armature, the sleeve configured to change the inductance of the electromagnetic force operating on the armature.

10. The armature-needle assembly of claim 9, wherein the sleeve contains a throttle section of reduced thickness compared to the remainder of the sleeve, and wherein when an electromagnetic force is applied to the armature, the magnetic field traveling through the sleeve is saturated in the throttle section.

11. The armature-needle assembly of claim 9, wherein the sleeve is made from a non-magnetic material.

12. A method for forming an armature-needle assembly for a fuel injector, the armature-needle assembly having components that are adjustable to configurations in multiple settings for various types of automotive vehicles, the method comprising:

providing a needle having a nozzle end;

providing an armature having a recess located on one end of the armature;

providing a stop flange having an aperture for receiving the needle;

providing a guide plate having an aperture for receiving the needle, the aperture configured to allow the guide plate to slide along the needle;

providing a coiled spring configured to surround the needle;

arranging the guide plate in the recess of the armature;

fixing the guide plate to the armature; and arranging the stop flange, guide plate and armature on the needle.

* * * * *